US006953197B2

(12) United States Patent
Hartmann

(10) Patent No.: US 6,953,197 B2
(45) Date of Patent: Oct. 11, 2005

(54) QUICK-ACTION LOCKING DEVICE FOR AN ELECTRIC POWER TOOL

(75) Inventor: Markus Hartmann, Mauerstetten (DE)

(73) Assignee: Hilti Aktiengesellschaft, Schaan (LI)

( * ) Notice: Subject to any disclaimer, the term of this patent is extended or adjusted under 35 U.S.C. 154(b) by 125 days.

(21) Appl. No.: 09/928,777

(22) Filed: Aug. 13, 2001

(65) Prior Publication Data

US 2002/0035882 A1 Mar. 28, 2002

(30) Foreign Application Priority Data

Aug. 17, 2000 (DE) ..... 100 40 330

(51) Int. Cl.[7] ..... B24B 45/00

(52) U.S. Cl. ..... 279/141; 279/8; 83/698.41; 83/666; 83/665; 83/698.31; 83/676; 403/321

(58) Field of Search ..... 279/141, 8; 409/231, 409/232, 233; 83/698.41, 666, 665, 698.31, 83/676; 403/321, 222.1, 220.3, 220.4; 30/276, 30/388; 74/55, 557, 569

(56) References Cited

U.S. PATENT DOCUMENTS 4,597,227 A * 7/1986 Gentischer et al. ..... 451/342
4,779,382 A * 10/1988 Rudolf et al. ..... 83/666
4,989,374 A * 2/1991 Rudolf et al. ..... 451/342
5,058,909 A * 10/1991 Rudolf et al. ..... 83/666
5,157,873 A * 10/1992 Rudolf et al. ..... 83/666
5,303,688 A * 4/1994 Chiuminatta et al. ..... 83/676
5,601,483 A 2/1997 Rudolf, et al.
6,094,824 A * 8/2000 Takeshita ..... 30/276

FOREIGN PATENT DOCUMENTS

DE 3523746 1/1987
DE 4336620 5/1995

* cited by examiner

*Primary Examiner*—John Sipos
*Assistant Examiner*—Michelle Lopez
(74) *Attorney, Agent, or Firm*—Sidley Austin Brown & Wood, LLP

(57) ABSTRACT

A quick-action locking device for an electric power tool including a locking spindle (4) axially displaceable in the hollow spindle (2) of the electrical power tool between a working tool locking position and a working tool exchange position, and a locking lever (6) provided at the end of the locking spindle remote from the working tool and having a slider cooperating with the locking spindle (4) for displacing the same, upon a pivotal movement of the locking lever (6), to its tool exchange position, with the slider (8) having a contact region engageable with a contact surface provided at the end of the locking spindle (4) remote from the working tool (3), and with the contact surface of the locking spindle (4) having an extent, in a pivotal direction of the locking lever (6), corresponding to at least the radial distance (a) of the contact region from the pivot axis (9) of the lever multiplied, in the locking position of the locking lever (6), by a sin ($\alpha$) of an angle formed by a line, which defines the radial distance (a), with a longitudinal axis of the locking spindle (4).

8 Claims, 2 Drawing Sheets

QUICK-ACTION LOCKING DEVICE FOR AN ELECTRIC POWER TOOL

BACKGROUND OF THE INVENTION

1. Field of the Invention

The present invention relates to quick-action locking device for an electric power tool and, in particular, a circular saw and the like, and designed for securing a working tool to a motor-driven hollow spindle located in a housing of the power tool, with the quick-action locking device including a locking spindle axially displaceable in the hollow spindle of the electrical power tool, a resilient member for axially restraining the locking spindle, a locking flange cooperating with the locking spindle for securing the working tool to the hollow spindle for joint rotation therewith, and a locking lever provided at an end of the locking spindle remote from the working tool and pivotable about a pivot axis between a locking position, in which the working tool is secured to the spindle, and an exchange position in which the working tool can be replaced. The present invention also relates to an electric power tool with a quick-action locking device as described above.

2. Description of the Prior Art

Quick-action locking devices are used with the electrical power tools to provide for manual replacement of a working tool. Contrary to conventional locking devices, quick-action locking devices do not need an auxiliary tool for their locking and release. E.g., a conventional device can include a threaded rod with a locking flange, which is fixedly secured thereon, and a nut. With this device, the user has to use an auxiliary tool in form of an open-end wrench in order, e.g., to replace the working tool. Contrary to this, a quick-action locking device can be actuated with a locking lever in order to be able to replace a working tool.

A quick-action locking device is disclosed, e.g., in German Patent No. 4,336,620. The quick-action locking device disclosed in the German patent has a locking spindle axially displaceable in the hollow spindle of the electrical power tool and a resilient member for axially restraining the locking spindle. The locking device further includes a locking flange which cooperates with the locking spindle for securing the working tool to the spindle for joint rotation therewith. A locking lever is provided at an end of the locking spindle remote from the working tool for displacing the locking spindle between a locking position, in which the working tool is secured to the spindle, and an exchange position in which the working tool can be replaced. In the locking position, the working tool is located between the locking flange and the hollow spindle. At the end of the locking lever, which is secured on the pivot axis, there is provided an eccentric that is connected with the locking spindle by a bolt. Upon pivoting of the locking lever into the exchange position, the locking spindle is displaced by the eccentric axially in a direction of the working tool against the force of the resilient member and the frictional force generated between the eccentric and the bolt. In this position of the locking lever, the locking flange can be screwed out of the locking spindle without the use of any auxiliary tool, e.g., in order to replace the working tool.

The advantage of the disclosed quick-action locking device consists in that a working tool can be replaced without the user using any auxiliary tool. The user simply pivots the locking lever into its exchange position and screws the locking flange out of the hollow spindle so that he can remove the working tool or reposition it.

The drawback of the disclosed quick-action locking device consists in that the positional characteristics of the locking lever cannot be reliably maintained. If the force applied by the user is too large for the positioning process, the friction losses between the locking lever and the locking spindle are high. On the other hand, the locking lever can find itself in an intermediate position in which the locking device is neither locked nor released.

Accordingly, an object of the present invention is to provide a quick-action device for an electrical power tool which does not require application of a large force for its locking and release.

Another object of the present invention is to provide a quick-action locking device that is reliably retained in its locking and release positions.

A further object of the present invention is to provide a quick-action locking device that can be economically produced.

SUMMARY OF THE INVENTION

These and other objects of the present invention will become apparent hereinafter, are achieved by providing a quick-action locking device in which the locking lever has a slider for applying a force to the locking spindle for displacing the locking spindle against a biasing force of the resilient member upon a pivotal movement of the locking lever from the locking position to the exchange position, with the slider having a contact region engageable with a contact surface provided at the end of the locking spindle remote from the working tool and with the locking spindle having an extent, in a pivotal direction of the locking lever, corresponding to at least a radial distance of the contact region of the slider from the pivot axis of the lever multiplied by sin of an angle formed, in the locking position of the locking lever, by a line, which defines the radial distance, and a longitudinal axis of the locking spindle.

Because the lever includes a slider, the force, which the user needs to apply for pivoting the lever, is relatively small as the friction between the locking lever and the slider is very small. This feature of the present invention significantly reduces the required application force in quick-action locking devices with a high clamping force. Furthermore, by selecting an appropriate slider, it is possible to match the applied force with the necessary clamping force of the resilient member. If, e.g., a large clamping force is necessary, it is possible to use more expensive slide elements in order to achieve good sliding characteristics. Moreover, contrary to conventional quick-action locking devices, the use of sliders permits to substantially reduce wear, which substantially prolongs the service life of the locking device even with an excessive loading of the power tool. The dimensioning of the contact surface of the locking spindle insures a compact structure of the quick-action locking mechanism so that it does not occupy much space in the electric power tool and facilitates handling of the locking device.

In the preferred embodiment of the invention, the pivotal angle of the locking lever varies from 30° to 120° which insures a good adjusting characteristic of the inventive quick-action locking device. Further, the pivot angle determines the travel path of the locking spindle with respect to the tool spindle. The greater is the pivot angle the greater is the travel path of the locking spindle between its locking and release or working tool exchange positions. However, a large travel path of the locking spindle increases the dimensions of the locking device as the size of the contact surface increases with the increase of the pivot angle. It was found that for hand-operated circular saws, a pivot angle of the locking lever of 80° would be optimal.

Advantageously, in the exchange position of the locking lever, the line that defines the radial distance between the contact region of the slider and the pivot axis of the locking lever forms with the longitudinal axis of the locking spindle an end angle that amounts to from about 5° to about 30°. This permits to eliminate indefinite intermediate positions of the inventive quick-action locking device. The locking lever occupies either the locking position or the exchange position. In particular, in the exchange position, a stop surface precisely determines the position of the locking lever. The end angle permits to reliably adjust the amount of the pivotal movement of the locking lever into its exchange position. The larger is the end angle, the greater is the return travel path of the locking spindle into its locking position, which increases the operating time. On the other hand, the end angle insures a reliable retention of the locking spindle in the exchange position.

Preferably, the end angle amounts to 10°. The 10° degree angle insures an optimal locking of the locking spindle in the exchange position, with the entire structure still being rather compact.

Advantageously, the slider is formed as an annular support member having a predetermined radius and an axis of which extends parallel to the pivot axis. Such a slider insures an economical manufacturing, while permitting to obtain high clamping forces. Annular support elements (bearings) are generally characterized by their ability to withstand large loads, small friction, and a long service life. Their manufacture is very cost-effective as there is a need in a large number of them.

According to advantageous embodiment of the invention, the radius of the annular support element or member amounts to from 0.2 to 0.6 of the radial distance between the contact region of the slider and the pivot axis and, preferably, to 0.4 of the radial distance. A slider with such a radius permits to obtain optimal setting characteristics.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
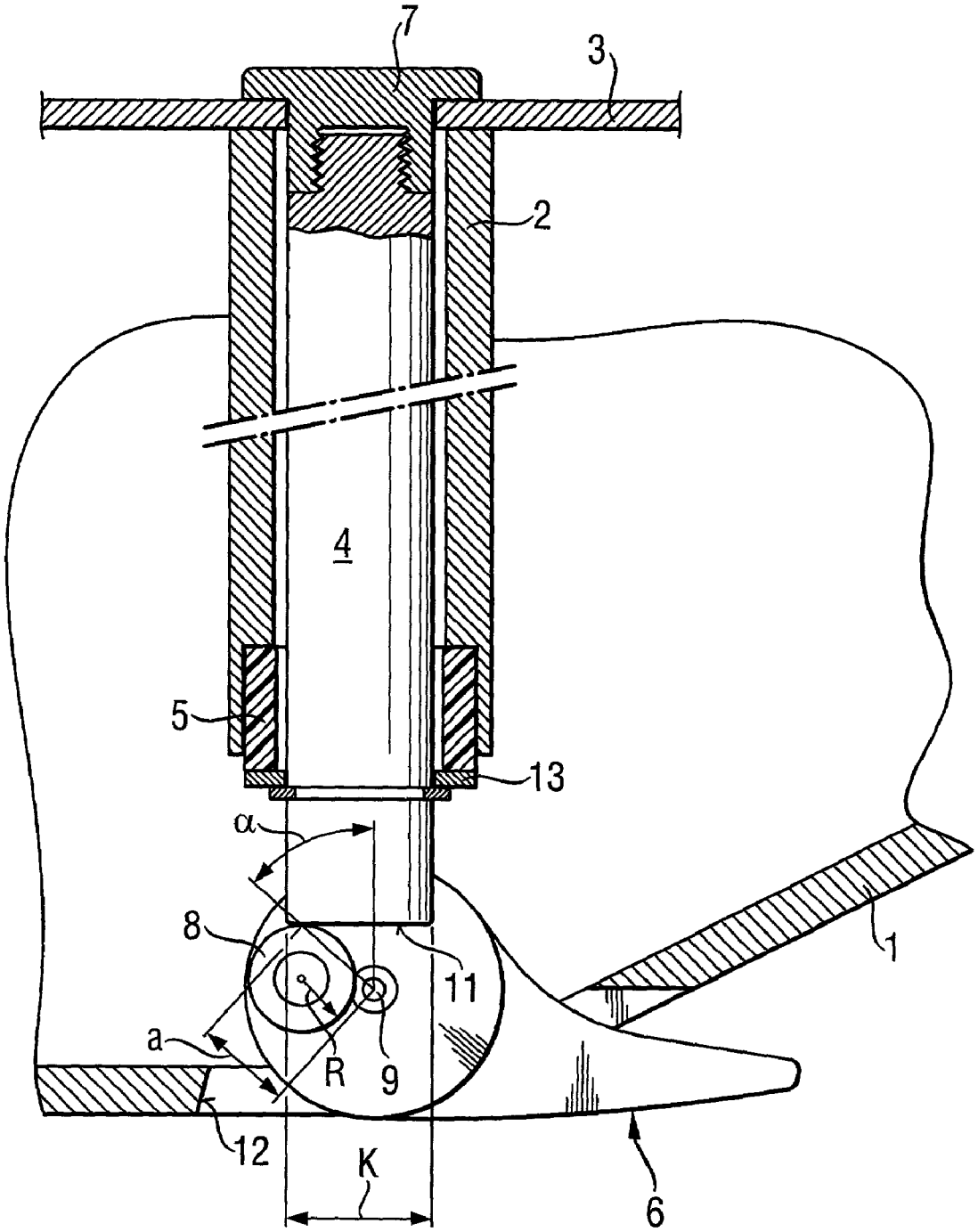
FIG. 1 a cross-sectional view of a quick-action locking device for an electrical power tool according to the present invention in a locking position of the device.
Figure 2:
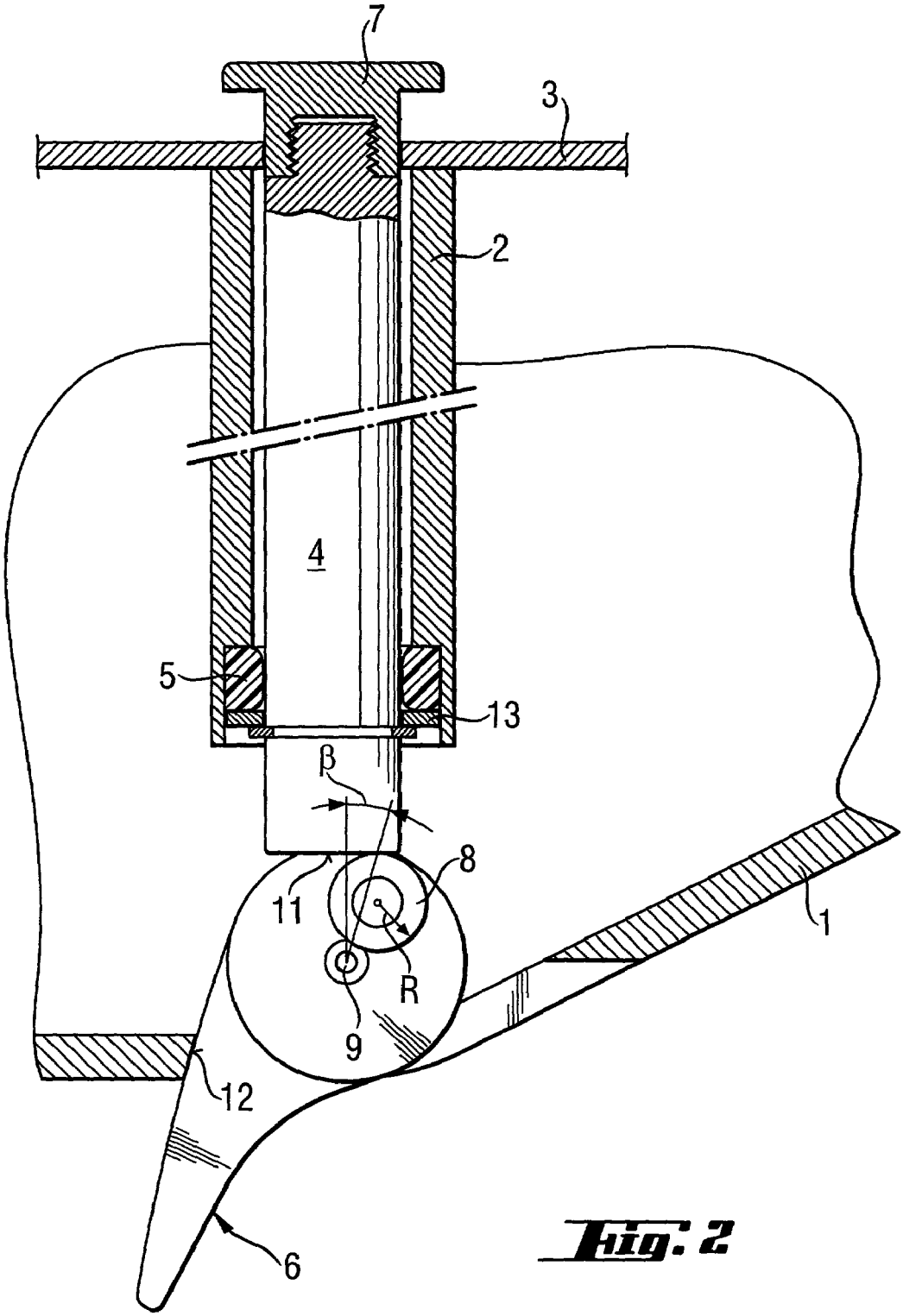
FIG. 2 a cross-sectional view of the inventive quick-action locking device in a position in which the locking spindle is in contact with a slider.

A quick-action locking device for an electrical power tool according to the present invention, which is shown in FIGS. 1–2, is designed for securing a working tool 3 on a hollow, motor-driven spindle 2 located in a housing 1 of the electrical power tool. The quick-action locking device has a locking spindle 4 axially displaceable in the hollow spindle 2 of the power tool. The locking spindle 4 is axially restrained with a resilient member 5. The resilient member 5 is located in a stepped bore formed in the spindle 2 at its end remote from the working tool 3. The resilient member 5 has one of its end supported against a shoulder formed in the stepped bore, and is supported at its opposite end by a flange 13 secured on the locking spindle 4. A locking lever 6, which is secured to the locking spindle 4 at its end remote from the working tool 3, provides for displacement of the quick-action locking device between its locking position which is shown in FIG. 1, and an exchange position shown in FIG. 2. In the locking position of the quick-action locking device, the working tool 3 is secured between the working tool 3 and the locking flange 7 of the quick-action locking device.

Upon a pivotal movement of the locking lever 6 from the locking position into the exchange position, the locking spindle is displaced by a slider 8, which is formed, in particular, as an annular support member, against the force of the resilient member 5 in a direction of the working tool 3. The point of contact of the slider 8 with the locking spindle 4 is radially spaced from the rotational or pivot axis 9 of the locking lever 6 by a distance a. In this position of the locking spindle 4 the locking flange 7 can be screwed out, without the use of any auxiliary tool, and the working tool 3, which is located between the locking flange 7 and the spindle 2, can be replaced. An end angle β, which is formed between a longitudinal axis of the locking spindle 4 and a line, which defines the distance a, insures retaining of the locking spindle 4 in the exchange position of the quick-action locking device. In this position, the lever 6 is supported against a stop surface 12 of the housing 1 of the electric power tool.

FIG. 1 shows a position of the locking lever 6 in which the slider contacts the locking spindle 4 but the locking lever 6 does not apply any force to the resilient member 5. In this position of the locking lever 6, the longitudinal axis of the locking spindle 4 forms with the line, which defines the distance a an angle a of about 80°. The contact surface 11 of the locking spindle 4 has an extent, in the pivot direction of the locking lever 6, corresponding to the distance a multiplied by sin (α).

Though the present invention was shown and described with references to the preferred embodiment, such are merely illustrative of the present invention and are not to be construed as a limitation thereof, and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. A quick-action locking device for an electrical power tool and designed for securing a working tool (3) to a motor-driven hollow spindle (2) located in a housing (1) of the power tool, the quick-action locking device comprising a locking spindle (4) axially displaceable in the hollow spindle (2) of the electrical power tool; a resilient member (5) for axially restraining the locking spindle (4); a locking flange (7) cooperating with the locking spindle (4) for securing the working tool (3) to the spindle (2) for joint rotation therewith; and a locking lever (6) provided at an end of the locking spindle (4) remote from the working tool (3) and pivotable about a pivot axis (9) between a locking position, in which the working tool (3) is secured to the spindle (2), and an exchange position in which the working tool (3) can be replaced, the locking lever (6) having a slider (8) for applying a force to the locking spindle (4) for displacing the locking spindle (4) against a biasing force of the resilient member (5) upon a pivotal movement of the locking lever (6) from the locking position to the exchange position, the slider (8) having a contact region engageable with a contact surface (11) provided at the end of the locking spindle (4) remote from the working tool (3), wherein the contact surface (11) of the locking spindle (4) has a length (K) corresponding to at least a distance (a) between a point of contact of the contact region of the slider (8) with the contact surface (11) of the spindle (4) in the locking position of the lever (6), and the pivot axis (9) of the locking lever (6), multiplied by sin ($\alpha$) of an angle ($\alpha$) formed by a line passing through the contact point and the pivot axis (9) of the locking lever (6), with a longitudinal axis of the spindle (4); and wherein the slider (8) is formed as an annular support member having a predetermined constant radius (R) and an axis of which extends parallel to and spaced from the pivot axis (9) and wherein the radius R runs from the axis of the annular support member.

2. A quick-action locking device according to claim 1, wherein the angle ($\alpha$), which the passing line forms with the longitudinal axis of the locking spindle (4), amounts to from 30° to 120°.

3. A quick-action locking device according to claim 2, wherein the angle ($\alpha$) is equal to about 80°.

4. A quick-action locking device according to 1, wherein the predetermined radius (R) of the slider-forming annular support member amounts to 0.2–9, of the distance (a) between the contact point and the pivot axis (9).

5. A quick-action locking device according to claim 4, wherein the predetermined radius (R) amounts to about 0.4 of the distance (a) between the contact point and the pivot axis (9).

6. A quick-action locking device according to claim 1, wherein in the exchange position of the locking lever (6), the passing line forms with the longitudinal axis of the locking spindle (4) an end angle ($\beta$) that amounts from about 5° to about 30°.

7. A quick-action locking device according to claim 6, wherein the end angle ($\beta$) amounts to about 10°.

8. An electrical power tool, comprising a housing (1); a hollow motor-driven spindle (2) located in the housing (1); a working tool (3); and a quick-action locking device for securing the working tool (3) to the spindle (2), the quick-action locking device comprising a locking spindle (4) axially displaceable in the hollow spindle (2) of the electrical power tool; a resilient member (5) for axially restraining the locking spindle (4); a locking flange (7) cooperating with the locking spindle (4) for securing the working tool (3) to the spindle (2) for joint rotation therewith; and a locking lever (6) provided at an end of the locking spindle (4) remote from the working tool (3) and pivotable about a pivot axis (9) between a locking position, in which the working tool (3) is secured to the spindle (2), and an exchange position in which the working tool (3) can be replaced, the locking lever (6) having a slider (8) for applying a force to the locking spindle (4) for displacing the locking spindle (4) against a biasing force of the resilient member (5) upon a pivotal movement of the locking lever (6) from the locking position to the exchange position, the slider (8) having a contact region engageable with a contact surface (11) provided at the end of the locking spindle (4) remote from the working tool (3), wherein the contact surface (11) of the locking spindle (4) has a length (K) substantially equal to a distance (a) between a point of contact of the contact region of the slider (8) with the contact surface (11) of the spindle (4) in the locking position of the lever (6) and the pivot axis (9) of the locking lever (6), multiplied by sin ($\alpha$) of angle ($\alpha$) formed by a line passing through the contact point and the pivot axis (9) of the locking lever (6), with a longitudinal axis of the spindle (4); and wherein, the slider (8) is formed as an annular support member having a predetermined radius and an axis of which extends parallel to and spaced from the pivot axis.

* * * * *